US010227996B2

(12) United States Patent
Thoms et al.

(10) Patent No.: US 10,227,996 B2
(45) Date of Patent: Mar. 12, 2019

(54) HYDROSTATIC DISPLACEMENT UNIT WITH REDUCED HYSTERESIS

(71) Applicant: Danfoss Power Solutions G.m.b.H & Co. OHG, Neumünster (DE)

(72) Inventors: Reinhardt Thoms, Holzbunge (DE); Martin Wuestefeld, Neumünster (DE)

(73) Assignee: Danfoss Power Solutions GmbH & Co. OHG, Neumunster (DE)

( * ) Notice: Subject to any disclaimer, the term of this patent is extended or adjusted under 35 U.S.C. 154(b) by 190 days.

(21) Appl. No.: 15/260,567

(22) Filed: Sep. 9, 2016

(65) Prior Publication Data

US 2017/0089362 A1 Mar. 30, 2017
US 2017/0356471 A9 Dec. 14, 2017

(30) Foreign Application Priority Data

Sep. 28, 2015 (DE) ..... 10 2015 218 578

(51) Int. Cl.

| | |
|---|---|
| ***F15B 9/04*** | (2006.01) |
| ***F15B 13/04*** | (2006.01) |
| ***F15B 21/12*** | (2006.01) |
| ***F04B 1/32*** | (2006.01) |
| ***F04B 49/00*** | (2006.01) |

(52) U.S. Cl.

CPC ..... *F15B 9/04* (2013.01); *F04B 1/32* (2013.01); *F04B 49/002* (2013.01); *F15B 13/0402* (2013.01); *F15B 21/12* (2013.01); *F15B 2211/20553* (2013.01)

(58) Field of Classification Search

CPC .. F15B 9/04; F04B 1/32; F04B 49/002; F04B 49/06; F01B 3/102

See application file for complete search history.

(56) References Cited

U.S. PATENT DOCUMENTS 5,139,227 A * 8/1992 Sumida ..... F02M 3/075 251/129.08
7,174,824 B2 * 2/2007 Koskimaki ..... B25D 9/18 91/218
7,299,738 B2 * 11/2007 Thoms ..... F04B 1/324 91/506
7,343,845 B2 * 3/2008 Wirtl ..... G05D 16/163 91/358 R
7,415,821 B2 * 8/2008 Heinz ..... F03C 1/003 60/445

(Continued)

FOREIGN PATENT DOCUMENTS

CN 1750907 A 3/2006
CN 1920723 A 2/2007

(Continued)

*Primary Examiner* — Thomas E Lazo

(74) *Attorney, Agent, or Firm* — McCormick, Paulding & Huber LLP

(57) ABSTRACT

The invention relates to a displacement unit (1) of a hydraulic machine, for which the hysteresis is reduced. For this purpose, in the control spool (3) and/or at the control spool (3) a mass body (16) and a spring (17) are arranged, which are excited to resonance vibrations. The vibrations are self-excited and sustained by a partial flow rate of the hydraulic fluid which is modulated periodically. The high frequent vibrations are transmitted over the spring (17) onto the associated control spool (3), thereby reducing the friction and hence the hysteresis.

19 Claims, 9 Drawing Sheets

(56) References Cited

U.S. PATENT DOCUMENTS

| | | | | |
|---|---|---|---|---|
| 2006/0008358 | A1 | 1/2006 | Thoms et al. | |
| 2007/0000245 | A1 | 1/2007 | Beck et al. | |
| 2010/0200344 | A1* | 8/2010 | Knowles | F16F 15/12 188/290 |
| 2015/0050165 | A1* | 2/2015 | Zavadinka | F04B 1/324 417/270 |
| 2015/0285214 | A1 | 10/2015 | Thoms et al. | |

FOREIGN PATENT DOCUMENTS

| | | | | |
|---|---|---|---|---|
| CN | 102878126 | A | | 1/2013 |
| DE | 2161668 | C3 | | 5/1978 |
| DE | 102004033376 | B3 | | 12/2005 |
| DE | 102013216395 | A1 | | 2/2015 |
| DE | 102014206460 | B3 | | 7/2015 |
| GB | 2453146 | A | | 4/2009 |
| JP | 62218676 | A | * | 9/1987 |
| JP | S62218676 | A | | 9/1987 |

* cited by examiner

HYDROSTATIC DISPLACEMENT UNIT WITH REDUCED HYSTERESIS

CROSS REFERENCE TO RELATED APPLICATION

Applicant hereby claims foreign priority benefits under U.S.C. § 119 from German Patent Application No. 102015218578.8 filed on Sep. 28, 2015, the content of which is incorporated by reference herein.

TECHNICAL FIELD

The invention relates to a hydrostatic displacement unit for the stepless adjustment of the displacement volume of a hydraulic machine.

BACKGROUND

Hydraulic machines with variable displacement volume or swallowing capacity comprise a hydrostatic displacement unit which, for instance, sets the angle position of a swash plate or bent axis. This displacement unit comprises two essential elements for adjusting and controlling the displacement volume of the hydraulic machine. That is firstly the control unit, which converts incoming mechanical, pneumatical, hydraulical or electrical control signals into adequate control volume flow rates for the second essential element, the servo displacement unit, which engages with a displacement element of the hydraulic machine. The control unit and the servo displacement unit are connected to each other via fluid conducting control lines, which supply, respectively discharge the volume flow rates necessary for the servo displacement unit. In order to set a certain displacement volume of the hydraulic machine against actions of internal spring forces and external operational forces, the control volume flow rates have to be supplied under adequate pressure. Such a displacement unit for hydraulic machines is disclosed, for instance, in DE 10 2004 033 376 B3.

The control signals for the control unit are converted by actuators, preferably in axial force actions on the control spool. The signals can be of various manners, for instance, mechanically, hydraulic-mechanically and as well as electrically. For the conversion of electric signals solenoids or switching magnets serves as actuators. Often the control unit is of a mechanical design with movable parts, which, for instance, are implemented as control valves comprising a control cylinder and a control spool designed to move longitudinally. The control spool usually is moved by actuators engaging with the same in axial direction. Naturally, friction is acting during the movement of these parts, which leads to a mechanical Hysteresis. Such a Hysteresis shows among others that equal control signals on the control unit causes different control volume flow rates, respectively different control pressures, depending on whether the control signal is set with an increasing signal ramp or with a decreasing signal ramp. This is due to the fact that the motion of the parts of the control unit show different directions according to the increasing or the decreasing control signal ramp. Because of this, the friction forces act in different directions and, mostly, also with different strengths.

In general, hysteresis are not wanted as these influence in a hard controllable manner the control volume flow rate to be adjusted by the control unit according to given control signals, such that no unique value can be associated to one single control signal for the displacement of a hydraulic machine, as it depends on the control ramp with which the control signal was set, respectively out of which position the control spool was displaced in the control cylinder.

For example, in control units with electric actuation of the actuator, the hysteresis of actual actuator force, respectively of the actuator position can be a counteracted in that the electrical control signal is superimposed by an oscillation signal. This leads to a vibration of the movable parts of the actuator and therewith to a permanent high frequent reversal of the friction forces, which, for instance, are superimposed to the steady direction of forces resulting from the control signal ramp. Herewith the influence of the static friction on the actuator itself as well as on the actuated parts of the control unit, respectively on the control spool, is minimized, however, eventually, inaccuracies occur in the control of the control volume flow rates and, hence, of the displacement volume of the hydraulic machine if the control spool is to be displaced with pulsing force. When applying electric control signals, dither or pulses width modulated (PWM) signals are used, whose amplitude and frequency have to be adjusted to the requirements of a concrete design of the displacement unit. Pulse width modulated signals show the disadvantages vantages that their amplitudes depend on the height of the electrical signals and, hence, are not optimal in each and every control state. Dither signals are capable to hold the amplitudes in a broad but finally also limited band in a constant and optimal manner independent from the height of the electrical signal. However, not every amplitude, which, eventually, is optimal for minimizing the Hysteresis, is also suitable for the electronic control. Furthermore, it is difficult to apply a Hysteresis-reducing oscillation signal, if the activation is non-electric, respectively hydromechanic or pneumatic-mechanic.

In JPS62218676 (A) means for the reduction of hysteresis at a control spool are described, with which pulsations in the hydraulic fluid are acting directly on a front face of a control spool via an amplifying chamber arranged externally of a control unit and without interposition of a further actuator, whose pressure serves as control signal for the control unit. The pulsations or pressure fluctuations are created in the amplifying chamber by means of a mass oscillating on a spring. This system is sophisticated as the amplifying chamber needs its own charge pump, and, furthermore, this results in increasing space requirements for the additional assembly groups.

SUMMARY

The invention is based on the object to provide a hydrostatic displacement unit initially mentioned, with which the mechanical caused hysteresis of the displacement unit, in particular of a control unit arranged in the displacement unit, can be reduced in a simple, however reliable and robust manner, without influencing therewith the height of the control signal in whatsoever manner. A further object of the invention is to provide the possibility to retrofit displacement units of already existing hydraulic machines in a simple manner, without changing the complete displacement unit in doing so.

The solution of this object is given such that the displacement unit comprises a vibration unit, in particular an oscillation exciter, which by means of excitation forces generates oscillations in the vibration unit. Thereby the excitation forces are preferably independent from the actuator force, respectively the control signal. As the oscillation exciter is arranged directly at the control spool or at its mechanical feedback unit, these oscillations are transmittable as impulses to the control spool. For this purpose the vibration unit/the oscillation exciter is attached directly to the control spool, for example, such that oscillations created in the vibration unit are transmittable mechanically, hydraulically, hydraulically-mechanically or as well pneumatically to the control spool and/or to the actuator.

By means of the oscillations/impulses, in particular in longitudinal direction of the excited control spool, the same receives a permanently motion reversal preferably, with small amplitude and, further preferably, with high frequency. This permanent motion reversal is superimposed to the relatively slow motion of the control spool due to the control ramp. Under high frequency it is to be understood in this case that the oscillation motion of the control spool caused by the vibration unit runs quicker as the motion which is caused by the actuator forces acting on the control spool, and with which a displacement of the hydraulic machine is obtained by means of conversion of the control signal, respectively the control signal pressure. Further preferably the time constant (period) of the oscillation is shorter as the displacement time of the control spool which is to be excited. Hence, to the uniform displacement of the control spool in the control cylinder a kind of oscillation/vibration is superimposed. This vibration leads to lower the static friction forces of the control spool by means of the permanent motion reversal, whereby, at the same time, reducing the Hysteresis effects.

A preferred embodiment of the inventive displacement unit can be consist in that the excitation forces are created by electrical, magnetical, electromagnetical, pneumatical or hydraulic forces. For instance, the exciting forces can be created by a mass body excitable to oscillation, which can be made fully or partially of magnetic material and, further exemplarily, is excited to longitudinal oscillations in that alternative current is applied to inductive coils arranged thereon. Alternatively, such longitudinal oscillation of a mass body can be produced as well by electro-friction or electro-mechanically in the manner of a (house door) bell.

A further preferred embodiment of the inventive displacement unit consists in a hydraulic mechanic generation of the excitation forces. For this purpose the vibration unit comprises preferably a spring as well as a mass body arranged in a cavity of the control spool and movable in longitudinal direction of the spool. The mass body can be excited to oscillations, for instance, by means of a hydraulic fluid flow acting on the same. The mass body transmits these oscillations mechanically and/or hydraulically to the control spool, for instance, by means of the spring, which is force-locked to the respective control spool. Alternatively, the exciting forces can be transmitted also by hydraulic fluid, which, for instance, acts on the front faces of the oscillating mass body. The hydraulic fluid is incompressible and hence suitable for the transmission of forces, for example from a front face of the mass body to an opposite cross wall in the cavity of the control spool.

The frequency of the oscillation results, as commonly known, for instance, from the mass of the mass body and the spring coefficient. A damping of the oscillation due to friction forces, in particular due to the viscosity of the hydraulic fluid covering the oscillating mass body leads to a shifting of the resonance frequency in direction to lower values and to a broadening of the resonance curve such that, in practice, the frequency of the oscillation will be below the calculated frequency for the damping-free, idealistic case. Due to the damping of the oscillation a constant energy supply is necessary additionally, in order to maintain the oscillation. Thereby, via the size of the partial flow, respectively the pressure in the hydraulic fluid, which is supplied to the vibration unit, the height of the oscillation frequency and the amplitude, which is generated by the vibration unit can be influenced.

With the preferred integration of a vibration unit into the control spool, a simple and effective possibility is provided to reduce the existing hysteresis when adjusting the displacement volume of already existing hydraulic machines, wherein only the existing control spool has to be interchanged with an inventive control spool.

A further simple and effective possibility to retrofit already existing displacement units to an inventive displacement unit, one can think about to attach the vibration unit to a position feedback unit, for example. Ideally, the oscillation exciter can transmit the oscillation to the element of the position feedback unit which engages mechanically with the control spool.

In general, one single vibration unit respectively oscillation exciter which is connected directly to the control spool is sufficient in order to excite the control spool to oscillations and, hence, to lower effectively the hysteresis with regard to the position in the control cylinder. This is valid in particular with one part-control spools and also if the vibration unit is supplied by charge pressure. With oscillation exciters being excited by the control signal pressure, it is necessary—in particular with two-side displaceable control spools—to provide at each control spool side an oscillation exciter, as always only one side of the control spool is pressurized by control signal pressure and as only to one side of the control spool a control signal pressure is provided for pressurizing the servo displacement unit. If a control unit comprises more than one control spool, for each actuable control spool a vibration unit is to be provided.

Further preferred, the vibration unit is designed such that the oscillations are self-excited. This means that except of applying a control signal or a connection to an energy source in form of a provided charge pressure for the control unit, no further arrangements are necessary to activate the oscillation, since this can be self-created. It shall be understood that energy losses of the oscillating mass body have to be compensated, and which are given due to friction and by the damping effect of the hydraulic fluid flushing around. As energy source serves, for example, a partial flow rate of the hydraulic fluid under charge pressure branched-off of the hydraulic fluid channels for the control signal or from the hydraulic fluid supply of the displacement unit, or, for example, from another pressure conducting line of the displacement unit or of the hydraulic machine, in general. For example, these fluid channel leads from an area under charge pressure to an area under low pressure. Hydraulic fluid under pressure serves for the creation and sustainment of the excitation forces, wherein for this purpose, for example, the oscillating mass body opens or closes fluid channels arranged in the control spool. Analogously, the inventive vibration unit can be realized instead of hydraulically also pneumatically.

The displacement unit according to the invention is provided for the reduction of friction and the hysteresis effects related therewith and can be designed for an adjustment of the flow direction of the hydraulic working fluid in the hydraulic machine in the two directions, whereby the control unit can show only one or also two vibration units.

BRIEF DESCRIPTION OF THE DRAWINGS

The invention is explained in more detail in the following with the help of embodiments which are depicted in the Figures. It is shown in.

DETAILED DESCRIPTION

Figure 1:
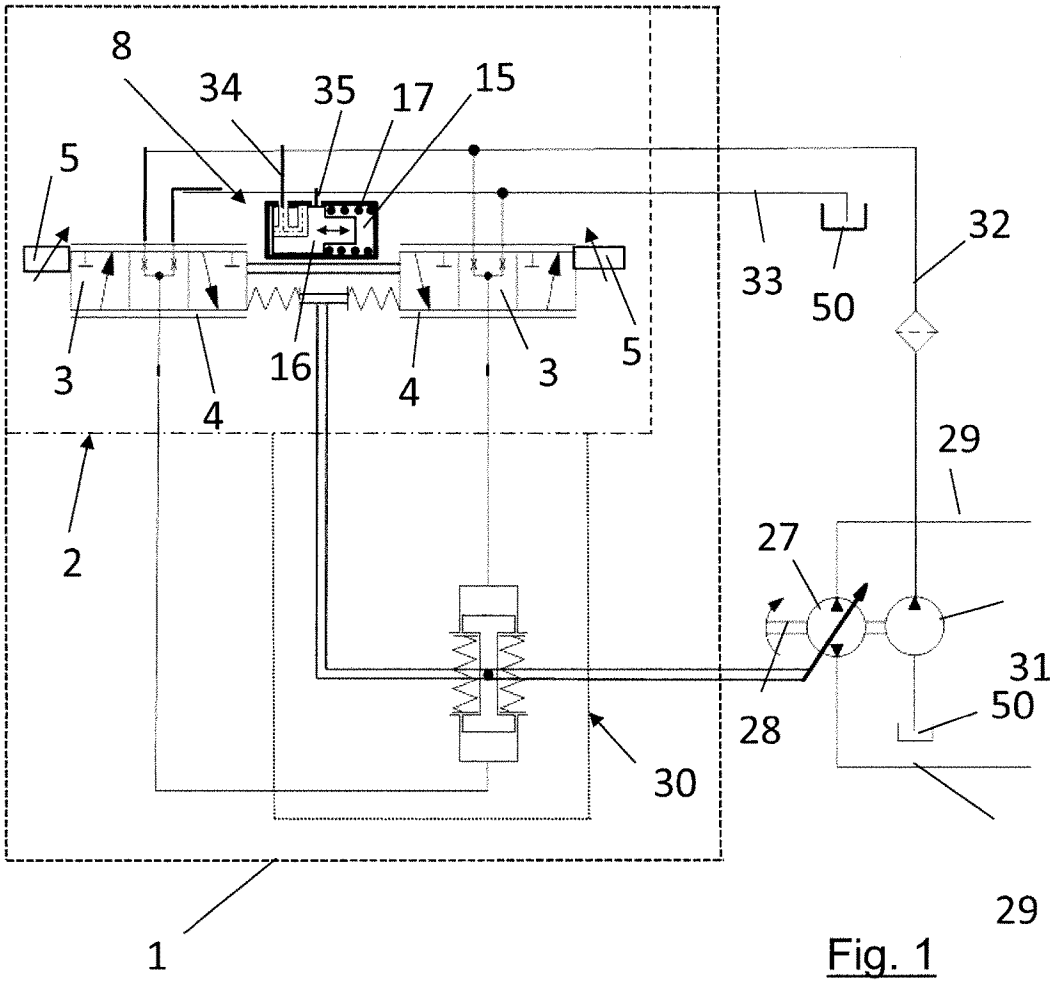
FIG. 1 is a hydraulic machine with a displacement unit according to the invention in a schematic view.

FIG. 1 shows a hydraulic machine 27 adjustable in two conveying directions, with a displacement unit 1 according to the invention in a schematic view. The hydraulic machine, which can be a hydraulic motor or a pump, comprises a driving or driven shaft 28 which, for instance, for a pump is driven by a not shown combustion engine. In this case, the pump conveys via lines 29 a fluid to and from a consumer. Thereby, a servo displacement unit 30 serves for the adjustment of the displacement volume and the conveying direction of the hydraulic fluid, which, for instance, can be done by varying the displacement angle of a swash plate or a bent axis of the pump. The control of the servo displacement unit 30 is effected over a control unit 2 with two control cylinders 4, in each of which a control spool 3 is mounted movable longitudinally. Thereby, both control spools 3 are connected rigid to each other such that a displacement of one control spool 3 causes the displacement of the other control spool 3 as well. The control spools 3 are displaced in this embodiment by two proportial magnets used as actuators according to control commands of a not shown control electronic of the hydraulic machine 27, whereby via lines 32, 33 fluid flows provided by a charge pump 31 are guided to and from the servo displacement unit 30 or to a tank 50 of the hydraulic machine 27. These details of the design and the operation of a hydraulic machine 27 are known to a person skilled in the art such that further details can be omitted. For this purpose it should be indicated merely that the actuators 5 for the displacement of both control spools 3 can be mechanic, pneumatic, electric or hydraulic means.

According to the invention the control spools 3 are operatively connected mechanically with an oscillation exciter as vibration unit 8. This vibration unit 8 is provided for bringing the control spools 3 in longitudinal oscillations, i.e. in oscillations parallel to its direction of movement within the control cylinders 4. Hereby, the hysteresis in the responding behavior of the control unit 2 is eliminated nearly completely, at least reduced significantly. The vibration unit 8 is configured exemplarily as a resonance oscillator having a mass body 16 and a spring 17, which are arranged in a cavity 15, and which are mounted movable in the longitudinal direction of the control spool 3 (see FIG. 2). The cavity 15 is connected via a line 34 to charge pump 31 and via a line 35 with tank 50. For further details of the operation of such a vibration unit 8, it is referred to the description of FIGS. 2 and 4.

Figure 2:
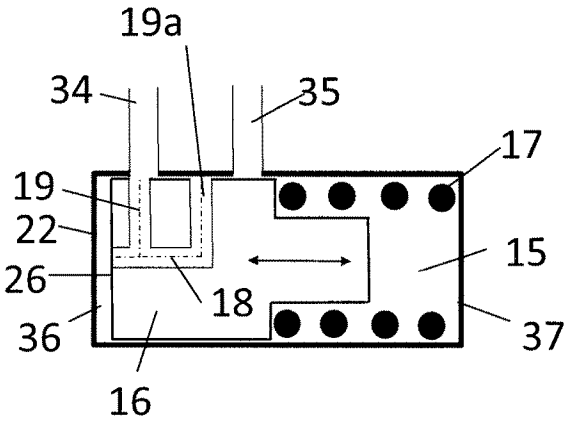
FIG. 2 is a schematic detail view of the vibration unit according to FIG. 1.

It shall be understood that instead of the vibration unit 8 shown in FIGS. 1 and 2, another kind of oscillation exciter 8 can be attached to the control spool as well. Such a control spool must not necessarily be in direct mechanic contact with a control spool 3, for example, can be coupled to the associated control spool 3 via a stationary or variable magnet field. Likewise, also piezoelectric or magnetostricitve oscillation exciters can be considered to be integrated in the corresponding control spool 3, for example.

FIG. 1 shows exemplarily a hydraulic machine 1 adjustable in both directions, in which the displacement unit 1 with the control unit 2 and the servo displacement 30 is designed, in general symmetrically. It shall be understood, however, that the inventive displacement unit can be applied also to a hydraulic machine 27 which can be adjusted only in one conveying direction. Here, the vibration unit 8 is only effective at one single control spool 3.

With the description of the following Figures all reference numerals for indicating the same constructive features are remained. Here, it is to be annotated for ensuring clarity single parts or elements are indicated with only one reference numeral even though if they are shown several times. In FIG. 2 a schematic detail view of an inventive vibration unit 8 according to FIG. 1 is shown. Here, a resonance oscillator is shown having a mass body 16 and a spring 17, which are arranged in a cavity 15, and which are mounted movable in longitudinal direction of cavity 15. The cavity 15 is connected via a line 34 with the charge pump 31 and via a line 35 with tank 50. In the mass body 16 a longitudinal channel 18 is formed, which ends in direction of a cross wall 22 of cavity 15. A cross wall 22 defines together with the opposite arranged front face 26 of mass body 16 a chamber 36, whose volume is variable according to the position of mass body 16.

From the longitudinal channel 18 two cross bores 19 and **19*a* are branched off, which leads to an outer side of mass body 16. The chamber 36 can be connected via the cross bores 19 and 19*a* as well as via longitudinal bore 18 with lines 34 and 35 hydraulically, wherein the line 34 comes from the charge pump 31 and the line 35 leads to tank 50. The lines 34 and 35 are arranged spaced from each other in the chamber such that by the displacement of the mass body 16 in cavity 15 always only one of both lines 34, 35 overlaps with one of the cross bores 19, 19*a***.

The way of function of vibration unit 8 is as follows: In the actual state shown in FIG. 2 of the vibration unit 8 the cross bore 19 overlaps with the opening of line 34, which is forced with hydraulic fluid under charge pressure by charge pump 31. The pressure fluid enters into chamber 36 over the longitudinal channel 18 and acts on the front face 26 of mass body 16. Hereby, the mass body 16 is displaced against the force of spring 17 in direction to the spring. With sufficient displacement of the mass body 16, the overlap with cross bore 19 and line 34 ends. Instead of this, the second cross bore **19*a* reaches overlap with the opening of line 35, which leads to tank 50 under low pressure. The pressure in chamber 36 is relieved, whereupon the spring 17 moves the mass body 16 in direction to cross wall 22. With the newly overlap of cross bore 19 with line 34, the pressure in chamber 36 rises again, whereupon the described procedure repeats. Hence, a oscillation of the mass body 16 in cavity 15 occurs, whose frequency is determined in known manner by the mass of the mass body 16, the pressure of the hydraulic fluid, which flows over line 34 into chamber 36, and the spring coefficient of spring 17. This frequency can be reduced in practice by the viscosity of the pressure fluid and further friction effects. The oscillation is transmitted, for example, via spring 17 to the wall of cavity 15, on which the same is supported, and hence, can be used for the generation of oscillation of the control spool 3 coupled with the same. One can imagine, that front face 26 of mass body 16 driven by the spring 17 abuts at cross wall 22 in the same manner, as the opposite front face of front face 26 can abut at a bottom surface of cavity 15 if the pressure guided into the chamber 36 via lines 34 moves the mass body 16 from the position shown in FIG. 2 towards the right. Naturally, an alternating abutment of the mass body 16 on cross wall 22 and on bottom surface 37** are covered by the inventive idea as well.

The kind of vibration unit 8 described above is self-excited as the pressure fluid supplied via line 34 leads to the motion of mass body 16 to the right. Thereby its motions are powered until a stationary state is reached, which is sustained by the interplay of supply and discharge of pressure fluid to and from chamber 36.

Figure 3:
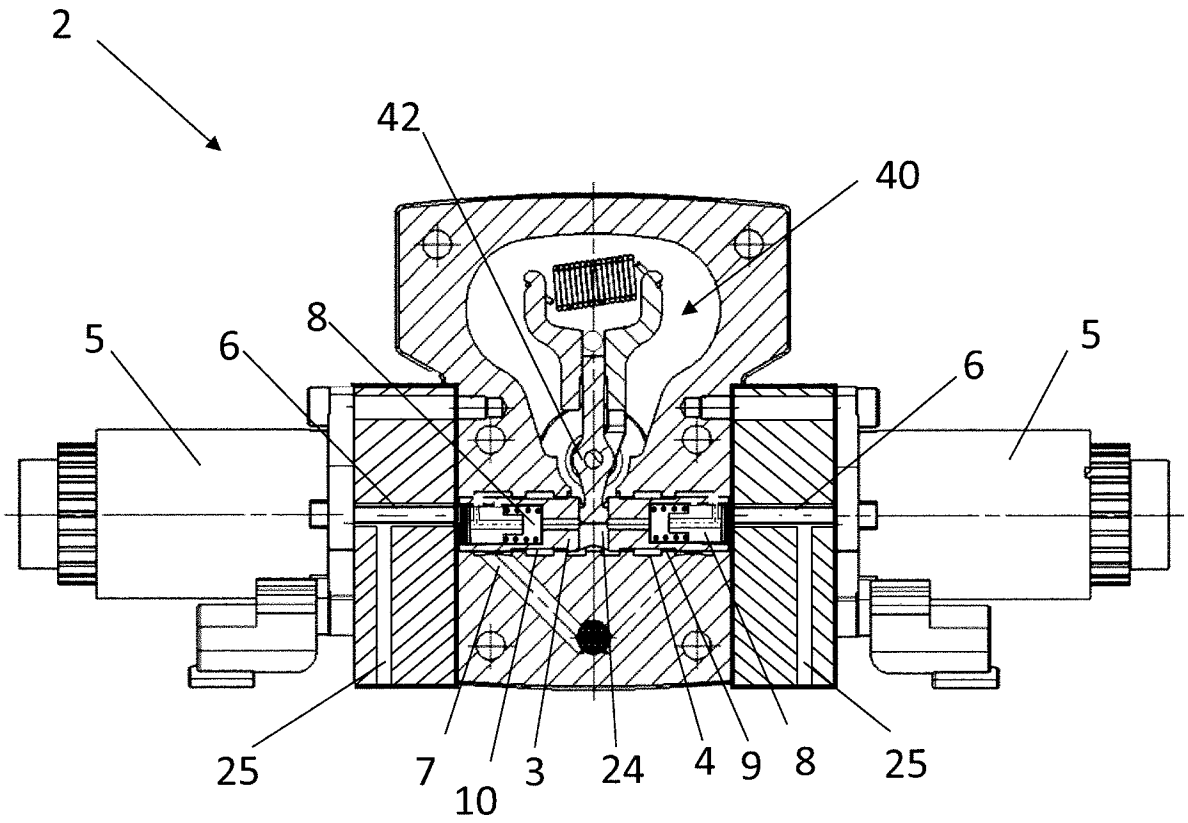
FIG. 3 is a cross-section of a hydrostatic displacement unit with a vibration unit according to the invention.

In FIG. 3 a hydrostatic displacement unit 1 with a vibration unit 8 according to the invention is shown partially in cross section. Shown is only the control unit, which provides the servo displacement unit 30 (not shown) with hydraulic fluid under control pressure. The control unit 2 shows a longitudinal bore forming the control cylinder 4. In the control cylinder 4 a symmetrically formed two-sided control spool 3 is arranged moveable longitudinally. The lever system of a position feedback unit 40 engages in a central portion of the control spool 3, which causes a neutral position of control spool 3. The way of operation of such a position feedback unit 40 in a displacement unit 1 is described in DE 10 2004 033 376 B3, for example, and is known to a person skilled in the art. For example, on pointer 42, which engages with control spool 3, a vibration unit 8 is arranged such that the direction of amplitude of the oscillation exciter is generally perpendicular to the pointer longitudinal direction. When retrofitting an existing displacement unit according to FIG. 2 a vibration unit 8 of the kind of a door bell would be preferred, however, all other kinds of oscillation-excitation are possible as well, and hence, covered by the inventive idea.

At the front faces of the control spool 3, which is shown in FIG. 3, actuators 5 engages exemplarily in form of proportional solenoids 5 via plungers 6, which according to the present control signal cause a displacement of the control spool 3 in control cylinder 4. Thereby the overlap of the control edges 9 which are formed in the control cylinder 4 and by ring grooves 10 and ribs 11 formed in control spool 3 is changed, which leads to an adjustment of the control pressure as commonly known, and which is guided to the servo displacement unit 30. The supply of the control unit 2 with hydraulic fluid and its discharge to servo displacement unit 30 or to a tank 50 of the hydraulic machine 27 are effected over fluid channels 7, 24, 25 which are shown in FIG. 3 only exemplarily.

In another preferred embodiment of the invention the vibration unit 8 is arranged in control spool 3. The vibration unit 8 comprises a spring 17 and a mass body 16 arranged in a cavity 15 of control spool 3. The mass body 16, the spring 17 and the control spool 3 are force-locked connected to each other and, hence, form a construction which is capable to oscillate. The mass body 16 is guided slidably in cavity 15 such that it can oscillate freely apart from the damping caused by the hydraulic fluid surrounding it. Further details of the exemplarily described control spool 3 with integrated vibration unit 8 are shown in FIG. 4.

Figure 4:
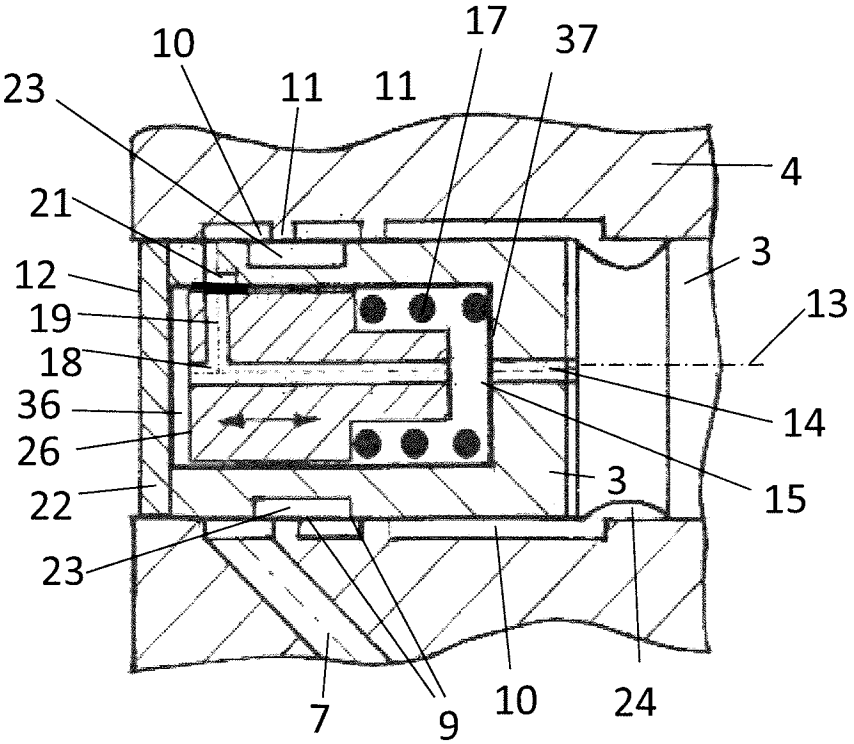
FIG. 4 is a detail view of a cross-section of a further displacement unit according to the invention.

FIG. 4 shows a detailed view of the displacement unit 1 according to FIG. 3 in cross-section. Shown is one end region of the control cylinder 4 with an end region of the control spool 3 guided therein slidably. In the inner wall of control cylinder 4 ring grooves 10 are formed which are separated by ribs 11. Together with the circumferential ring grooves 23 on the control spool 3 control edges 9 are formed hereby, which, as commonly known, determine the height of the control pressure reaching at the servo displacement unit 30. The hydraulic fluid under pressure is supplied for this purpose via a supply fluid channel 7 (see FIG. 3) and is discharged via the low pressure channel 24 to a tank 50, for example.

In a cavity 15 of the control spool 3 an inventive vibration unit 8 is arranged which, for instance, consists of a mass body 16 and a spring 17. A discharge bore 14 in the control spool 3 leads out of cavity 15 to a discharge outlet 24 under tank pressure, for instance. A cavity 15 is closed on the opposite side with a cross wall 22. The mass body 16 comprises a longitudinal channel 18, which crosses the same in direction of the longitudinal axis 13 of control spool 3. From longitudinal channel 18 a continuing cross bore 19 branches off which enters in a supply bore 21 in control spool 3. This supply bore 21 formed in the wall of cavity 15 of control spool 3 leads to the area of the fluid channel 7 respectively to a ring groove 10 communicating with the same. Thereby, the supply bore 21 is arranged such that it can be aligned at least partially or time partially with ring channel 23 and cross bore 19 in the mass body 16, this is determined in each case by the actual position of the mass body 16 in the cavity 15. The discharge bore 14, the longitudinal channel 18 with cross bore 19 and the supply bore 21 form altogether a fluid channel, which leads from the supply fluid channel 7 via the ring groove 10 to the low pressure channel 24.

The way of operation of the integrated vibration unit 8 shown exemplarily, is as follows: The hydraulic fluid under charge pressure coming from the supply channel 7 acts via the supply bore 21 in control spool 3 and via the cross bore 19 in mass body 16 onto the front face 26 of mass body 16 in cavity 15, and causes a displacement of mass body 16 against the force of spring 17 such that the overlap between the cross bore 19 and the supply bore 21 diminishes. Via the longitudinal channel 18 in mass body 16 and the discharge bore 14 in control spool 3, the pressure in chamber 36 can be relieved, whereby the hydraulic force on the mass body 16 decreases. If the hydraulic force on mass body 16 have been lowered to a value lower as the spring force of spring 17, the spring 17 moves the mass body 16 again in direction to the distal end of control spool 3. Hereby the overlap of cross bore 19 with supply bore 21 increases until the mass body 16 abuts at the cross wall 22, for example. Subsequently, the pressure in chamber 36 increases again and the mass body 16 is displaced again in direction to spring 17 if the hydraulic force on its front face 26 is high enough. This again causes the closure of the passage from supply bore 21 to cross bore 19 whereupon the pressure in cavity 15 decreases and the spring 17 moves the mass body 16 again towards the cross wall 22. This procedure is repeated periodically, which leads to the sustainment of the generated oscillation. Hereby, losses due to friction and damping due to the viscosity of the hydraulic fluid as well as due to the forces acting on the control spool 3 are compensated such that the oscillations are running in general with constant amplitude, once they have started. This procedure shows as well that the oscillation of the mass body 16 is self-excited.

The oscillating mass body 16 is connected via the spring 17 with the control spool 3 in a force-locked manner. The oscillation forces of the mass body 16 are transmitted via the cross wall 22 or the bottom surface 37 of cavity 15 onto the control spool 3 such that the same oscillates also in the tact of the high frequent oscillation of mass body 16. This oscillation superimposes the slower motion of the control spool 3, which acts under the influence of the control forces effected by the actuators 5. These oscillations of the control spool leads to a reduction of the fiction forces, for instance, with the control cylinder wall, as hereby at least the initial friction is eliminated, and hence, the sought reduction of the hysteresis is achieved. For the person with skills in the relevant art it can be seen that hydraulic forces which cause in the above given embodiment an oscillation of the mass body can be, correspondingly, in an analogous way also electric, mechanic, pneumatic or magnetical forces. Here, the working principal of a house door bell driven by means of a relay serves as a figurative example.

Figure 5:
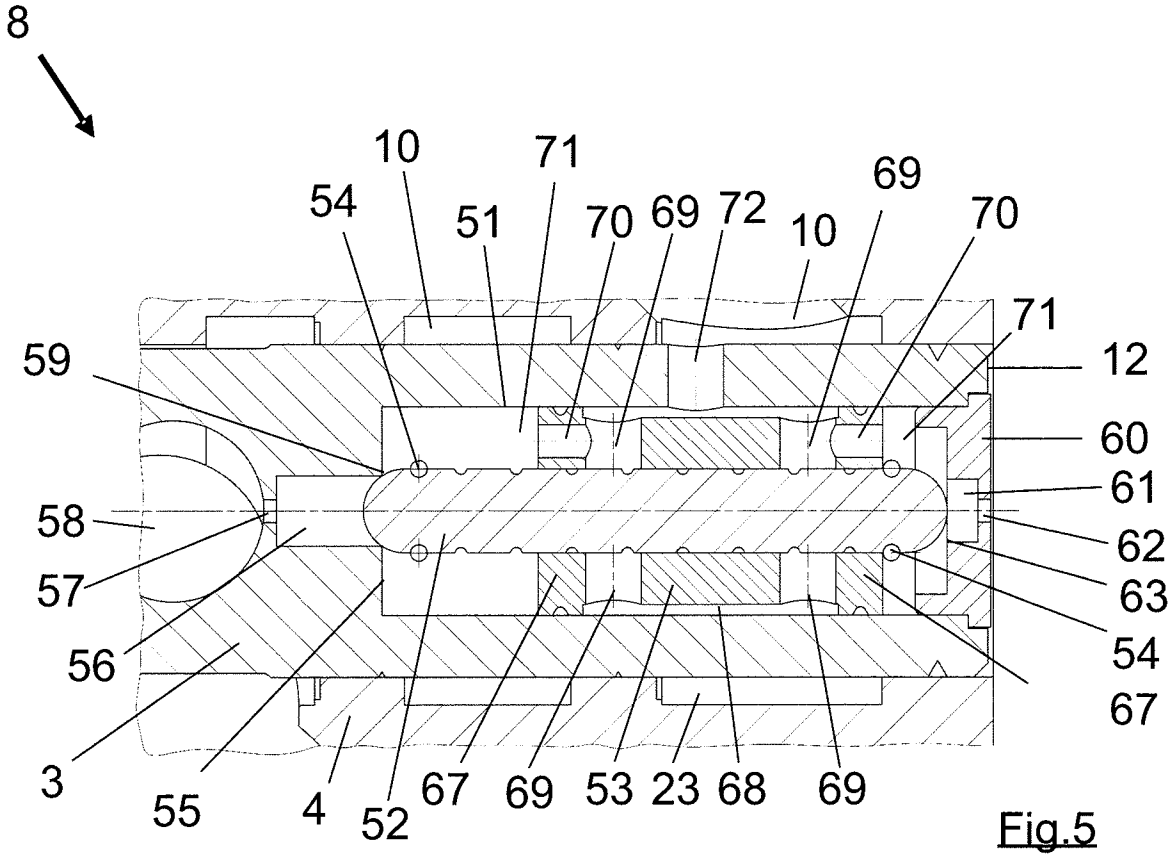
FIG. 5 is a cross-section of a control spool with a third embodiment of a vibration unit according to the invention being in a first oscillation state.

FIG. 5 shows a cross-section through a control spool 3 having a third embodiment of a vibration unit 8 according to the invention and being in a first oscillation state. The control spool 3—as before—is guided in the control cylinder 4 movable longitudinally. The control spool 3 is actuated by a not shown actuator, which engages at the front face 12 of control spool 3 or, alternatively, at a cap 60. For reasons of clarity, the control spool 3 is shown in this and all further Figures in a simplified manner. The ring channels, the passages and control edges usually formed within the same are not shown, however, are supposed to be existent, as they are common in the art.

The vibration unit 8 is arranged in a longitudinal bore 51 of control spool 3. The vibration unit 8 comprises a plunger 52 on which a bushing 53 is guided movable longitudinally. The bushing 53, however slidable, abuts sealed with its end regions 67 at the inner wall of longitudinal bore 51. The displacement range of bushing 53 is limited with regard to plunger 52 by stoppers, for example, in form of wire rings 54 which are arranged in the end regions of plunger 52.

From bottom 52 of longitudinal bore 51 a channel 56 leads via a dynamic pressure orifice 57 to the discharge outlet 58, which conducts hydraulic fluid to the not shown tank 50 of the hydraulic machine 27. At the opening of the channel 56 in bottom 55 of the longitudinal bore 51, a seat 59 is formed which, in interaction with the plunger 52, closes the channel 56; this is shown in FIG. 5. The other end of longitudinal bore 51 is closed with a cap 60 in which a channel 61 with a dynamic pressure orifice 62 is formed. This channel 61 also leads to tank 50, which is not shown here. In cap 60 there is also a seat 63 for the plunger 51 such that the channel 61 is closable liquid-tight by the plunger 52. However, channel 61 in the oscillation phase shown in FIG. 5 is opened for the passage of fluid, whereas the channel 56 is closed.

The outer walls of bushing 53 comprise a region 68 in the section between the two end regions 67 having a smaller diameter. In the proximity of the end regions 67, cross bores 69 are formed in bushing 53, from which oil supply orifices 70 lead to cavities 71 which are formed on both sides of bushing 53 in the longitudinal bore 51. A cross bore 72 in control spool 3 connects with region 68 with ring groove 10 arranged in the control cylinder 4, for feeding hydraulic fluid under charge pressure such that pressure fluid supplied via the fluid channel 7 can reach the cavity 71 via the oil supply orifice 70.

Figure 6:
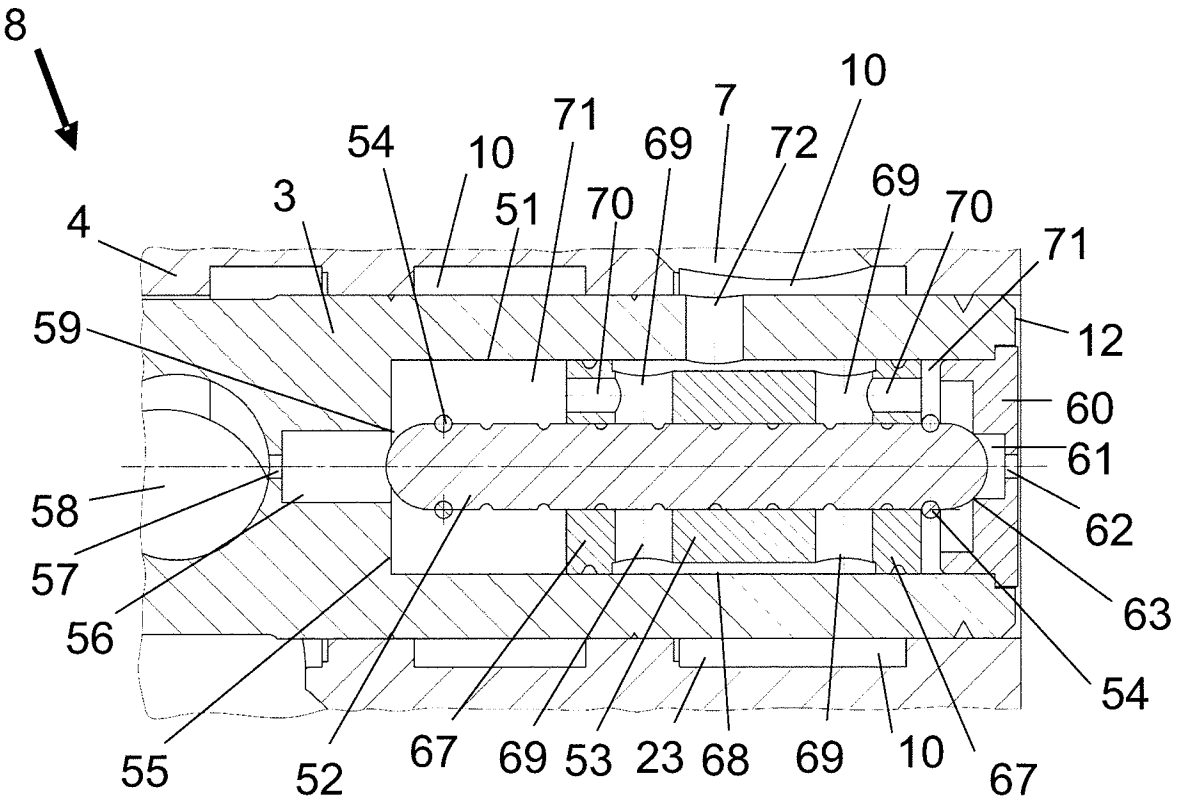
FIG. 6 is a cross-section of a control spool with a vibration unit according to FIG. 5 in a second oscillation state.

In FIG. 6 a cross section through a control spool 3 having a vibration unit 8 according to FIG. 5 is shown in a second oscillation state. In this phase of the oscillation of the vibration unit 8, the plunger 52 and the bushing 53 are shown in a second end position. The plunger 52 is displaced to the right and abuts with its end region on the seat 63 of cap 60. Hence, the channel 51 leading to tank 50 is closed, whereas channel 56, also leading to tank 50, is open.

The working principle of the vibration unit 8 according to this embodiment is as follows: In the state shown in FIG. 5, pressure fluid under charge pressure flows from the ring groove 10 via the cross bore 72, via the region with lower diameter 68 and via the cross bores 69 as well over the oil supply orifices 70 arranged on both sides of the bushing, to the cavities 71 of longitudinal bore 51 in control spool 3. Thereby, in the left-side cavity 71, a higher pressure is built up, as the channel 56 is closed by the plunger 52. The higher pressure on the left-side front face of bushing 53 moves the same to the right. The plunger 52 receives left-side lifting forces and on the right-side pressing forces by the pressure generated by the dynamic pressure orifice 62, which exceeds the lifting forces and, hence which press the plunger 52 onto the left-side seat 59. The bushing 53, which abuted before on left-side wire ring 54, now contacts the right-side wire ring 54. By this continuing pressurizing of the left-side cavity 71 and the kinetical energy, bushing 53 takes along plunger 52 during its motion to the right. This causes that plunger 52 lifts from the left-side seat 59 and, hence, opens the channel 56 to tank 50. Shortly afterwards the plunger 52 abuts on the right-side seat 63 and, closes therewith channel 61 to tank 50. This is the state shown in FIG. 6. Now, the procedure repeats, however in the opposite direction, as the pressure building up in the right-side cavity 71 is now higher than the pressure of the former filled left-side cavity 71, which is released now via channel 56. Hereby, the bushing slides in the longitudinal bore 51 of control spool 3 to the left. When bushing 53 abuts on the left wire ring 54 it takes along plunger 52 until this closes again channel 56.

This alternating opening and closing of the channels 56 and 61 leading to tank 50 caused by the motion of bushing 53 and taking along plunger 52 results in a periodical inversion of the direction of the motion. Hereby, the abutment of the plunger on the respective seat 59 or 36 exerts an impulse on the control spool 3, which, hence, is excited to a forced vibration. The oscillation is self-excited as the displacement of the plunger 52 and the bushing 53 can be excited by feeding pressure fluid to supply channel 7. The frequency of the generated oscillation can be set by the dimensioning of the single components of the vibration unit 8. Hereby, the height of the charge pressure, the mass of the plunger and the bushing, and its dimensioning as well as their cross sections and lengths of the participating channels and orifices as well as the viscosity of the hydraulic fluid are influencing variables.

Figure 7:
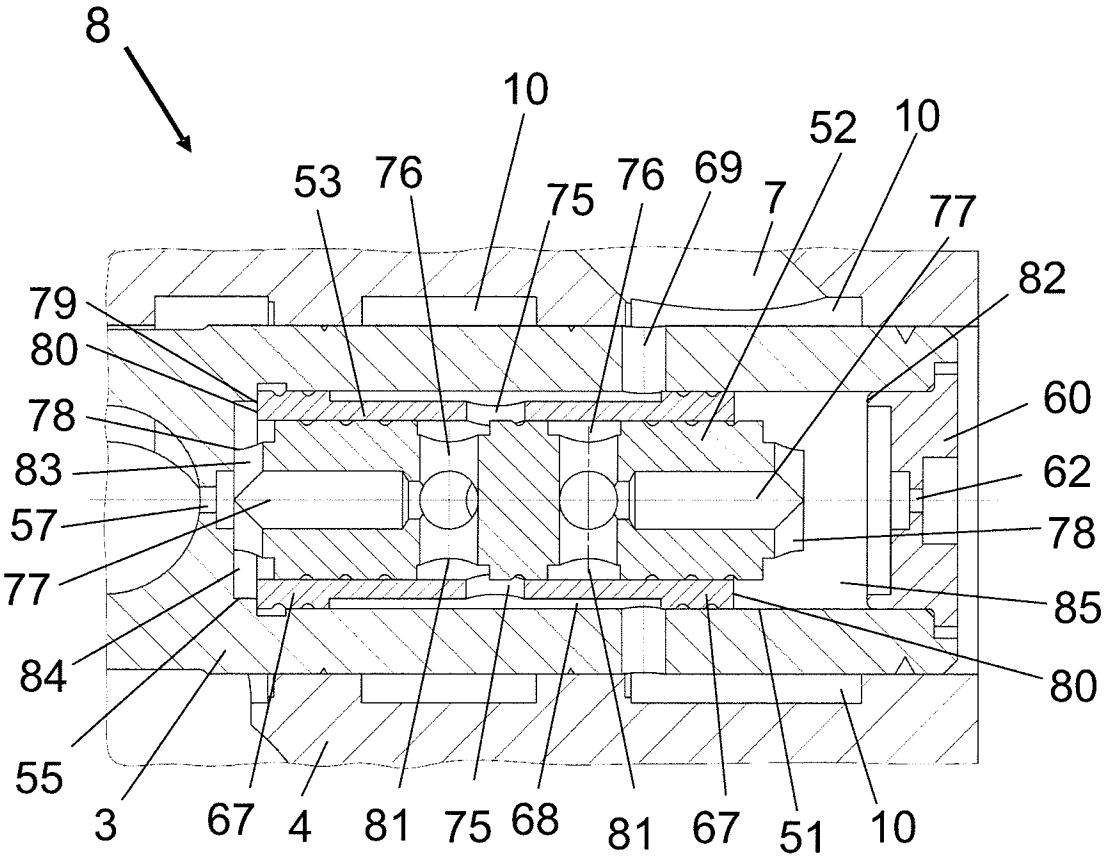
FIG. 7 is a cross-section of a control spool with a fourth embodiment of the vibration unit according to the invention in a first oscillation state.
Figure 8:
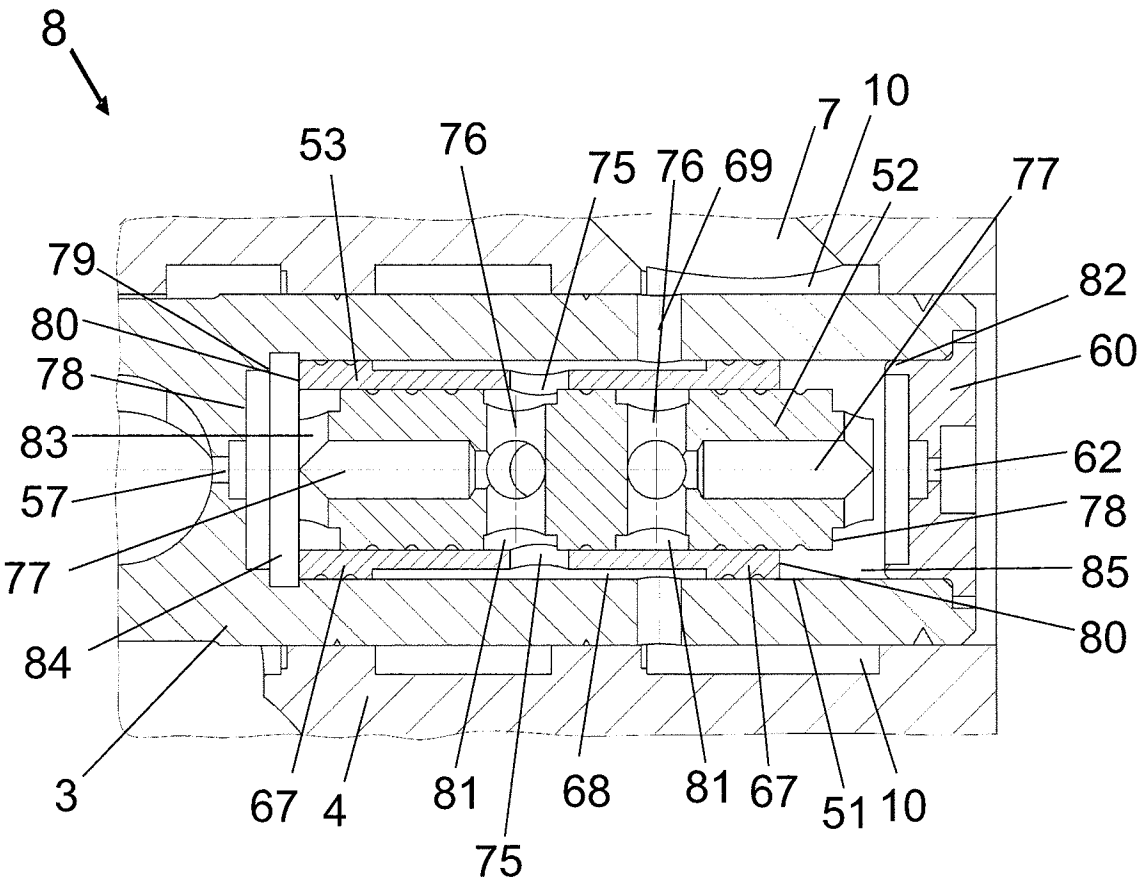
FIG. 8 is a cross-section of a control spool with a vibration unit according to FIG. 7 in a second oscillation state.
Figure 9:
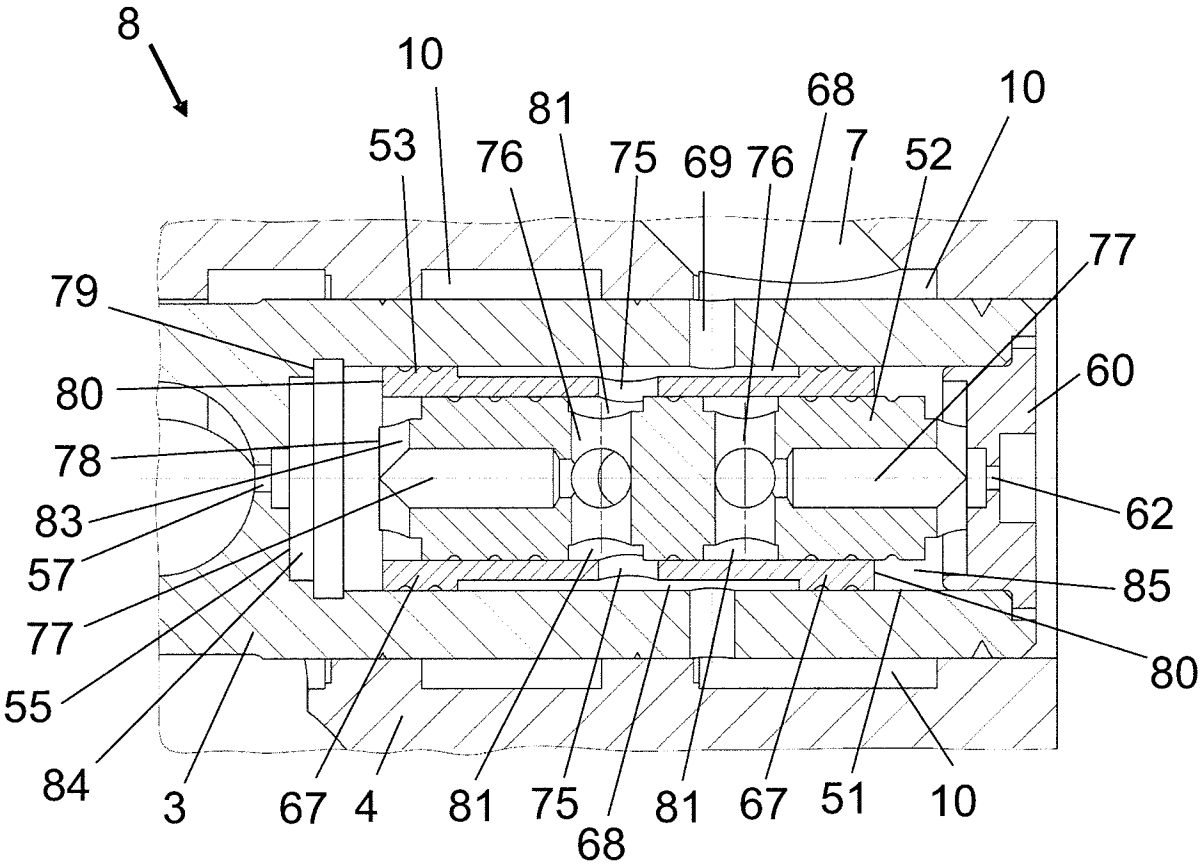
FIG. 9 is a cross-section of a control spool with a vibration unit according to FIG. 7 in a third oscillation state.
Figure 10:
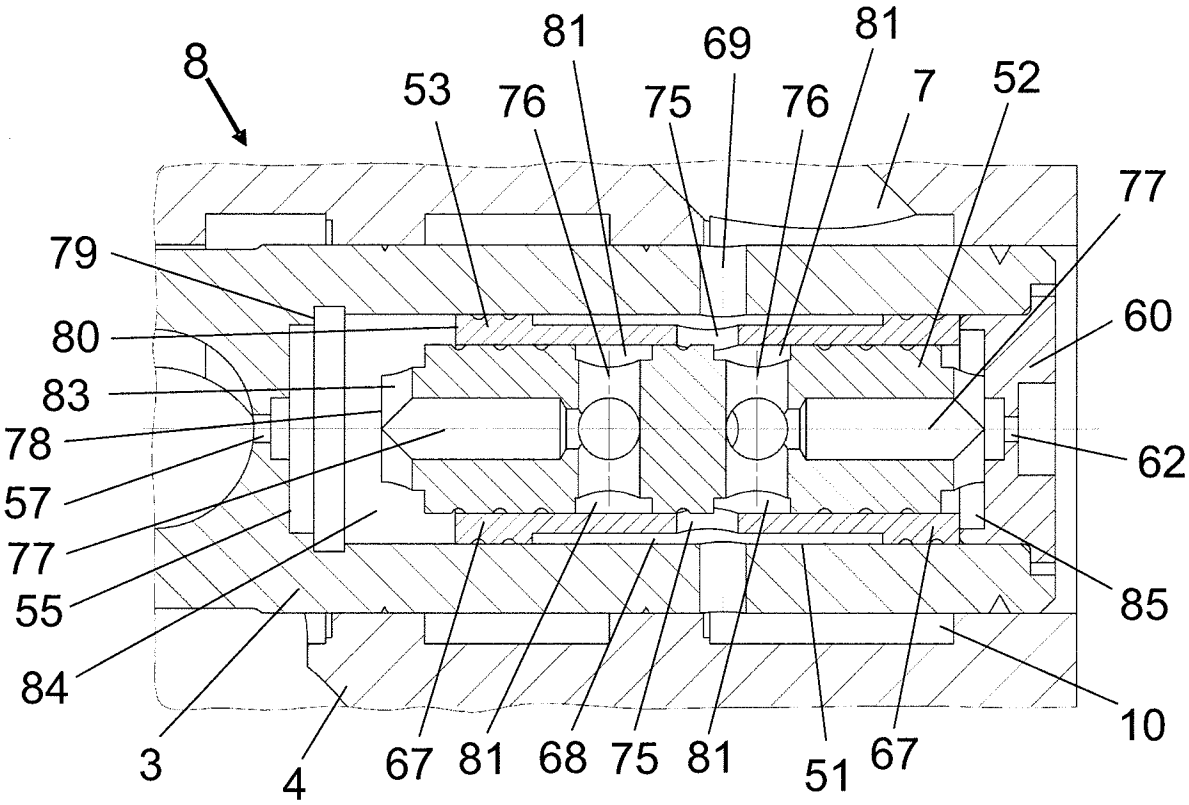
FIG. 10 is a cross-section of a control spool with a vibration unit according to FIG. 7 in a fourth oscillation state.

FIG. 7 shows a cross section through a control spool 3 comprising a fourth embodiment of a vibration unit 8 according to the invention in a first oscillation state. The FIGS. 8 to 10 show the same embodiment in further phase of the oscillation. This also preferred embodiment shows in general a similar construction of the vibration unit 8 as the one shown in the FIGS. 5 and 6. Therefore, the same elements are indicated with the same reference numerals. In the longitudinal bore 51 of the control spool 3, again a bushing 53 is guided movable longitudinally. It comprises, as before, to end regions 67, between which a region 68 of lower diameter is present. In the center of this region 68 radial passages 75 oriented towards the inner of bushing 53 are formed. The plunger 52 is arranged in a passing-through longitudinal bore of the bushing 53 movable longitudinally. The plunger 52 is formed symmetrically and shows right and left of its center a ring groove 81 as well as radial cross bores 76 crossing the plunger. From these cross bores 76 longitudinal channels 77 starts at the respective front faces 78 which discharge at the respective front faces 78 of plunger 52. The bottom 55 of the longitudinal bore 51 in control spool 3 is designed in its diameter such that a region with lower diameter forms a stop 79 for the left-side medial front face 80 of the bushing 53. On the opposite side of longitudinal bore 51 a correspondent stop 82 is formed on cap 60. The bushing 53 is shorter than the plunger 52 whose movement range is limited by the bottom of the longitudinal bore 51, respectively by the cap 60. Hence, the runnable displacement path of bushing 53 is longer than the one of plunger 52. In each of the bottom of the longitudinal bore 51 and the control spool 3 as well as in the cap 60 a dynamic pressure orifice 57, respectively 62, is formed which leads to the not shown tank 50.

In the state of the vibration unit 8 shown in FIG. 7, which can be seen as initial state of the oscillation cycle, the plunger 52 and the bushing 53 are situated at its left-side end position of its movement. The front face 78 of plunger 52 abuts at the bottom 55 of the longitudinal bore 51, front face 80 of bushing 53 on stopper 79. Pressure fluid under charge pressure flows from the charge pressure port 7 via the ring groove 10 and the cross bore 69 in control spool 3 into the region 68 of the bushing 53 with lower diameter. From there, the pressure fluid reaches via passages 75 the left ring groove 81 of plunger 52 and, further, via the cross bore 76 and longitudinal channel 77—stepped in its diameter in the sense of an orifice—to front face 78 of plunger 52. This front face 78 comprises a cross channel 83 via which the inward flowing pressure fluid can enter cavity 84 present in the bottom 55 of the longitudinal bore 51. Thereby, a pressure is built up in cavity 84, which acts on the respective front faces 70, 80 of plunger 52 and bushing 53. Both elements move under the effect of the pressure towards the right.

This motion state is shown in FIG. 8. The plunger 52 already has been lifted from the bottom of the longitudinal bore 51 as well as bushing 53 left the stopper 79. The ring groove 81 in plunger 52 still overlaps with the passages 75 of bushing 53 such that pressure fluid can still flow to the left side, wherein the dynamic pressure orifice 57 takes care of the generation and sustainment of sufficient pressure in the left-side cavity 84 of longitudinal bore 51. This pressure moves the plunger 52 and the bushing 53 further towards the right, wherein the plunger 52 runs ahead of plunger 53, as it is shown in FIG. 9, as the surface area of its front face 78 is bigger than the one of front face 80 of bushing 53. Preferably, its mass is lower too than the one of bushing 53.

In the state of oscillation shown in FIG. 9, the right-side front face 78 of the plunger 52 has reached already stop 82 at cap 60 and, therewith, is at the end of its displacement path. The bushing 53 indeed moved also further to the right, however, an overlap of the passages 75 with the left side ring groove 81 of the plunger 52 still exists. Hence, pressure fluid still flows into the left-side cavity 84 of the longitudinal bore 51. The pressure in cavity 84 moves the bushing further towards the right until the same abuts with its right front face 80 on the right stop 82. This right-side end state is shown in FIG. 10.

The state shown in FIG. 10 corresponds in general to the left-side initial state according to FIG. 7, however, with the difference that now the passages 75 of the busing 53 overlaps with the right-side ring groove 81 of the plunger 52. Thereby, pressure fluid flows into right-side cavity 85 of longitudinal bore 51 such that an inversion of the direction of movement of the plunger 52 and the bushing 53 occurs. Hereby, both elements run through the same states as it is shown in FIGS. 7 to 9, however, in inverted direction, whereupon an inversion of direction newly takes place. Hence, a periodical alternate motion of plunger 52 and bushing 53 is created; with other words, an oscillation. As both elements transmit an impulse onto the control spool 3 when impacting the bottom 55 of the longitudinal bore 51, respectively on the cap 60, the oscillation is transmitted on the control spool 3, which leads to the intended reduction of hysteresis. Even if both elements, plunger 52 and bushing 53, do not impact on bottom 55, the forced inversion of direction causes already vibration-stimulating impulses which can be transmitted by the hydraulic fluid onto the control spool 3.

The self-excitation of the oscillation and the determination of its frequency is done in the same way as with the embodiments described before.

While the present disclosure has been illustrated and described with respect to a particular embodiment thereof, it should be appreciated by those of ordinary skill in the art that various modifications to this disclosure may be made without departing from the spirit and scope of the present disclosure.

What is claimed is:

1. A displacement unit of a hydraulic machine for the stepless adjustment of the displacement volume, having a control valve by means of which hydraulic fluid under control pressure can be guided to a hydraulic servo displacement unit, wherein, caused by an actuator or by a direct set pressure signal, a displacement of a control spool arranged slidable in the control valve sets the height of the control pressure, which can be guided to the servo displacement unit for displacing a displacement element, wherein, the displacement unit comprises an oscillation exciter which can be set into vibrations by means of excitation forces which are independent from the force of the actuator, wherein the oscillation exciter is arranged directly at the control spool or at a position feedback unit which is mechanically coupled to the control spool such that the vibrations are transmittable to the control spool; and wherein the oscillation exciter is integrated into the control spool.

2. The displacement unit according to claim 1, wherein, the excitation forces are generatable by hydraulic, pneumatic, mechanic, electric or magnetic means.

3. The displacement unit according to claim 1, wherein the oscillation exciter comprises a mass body movable in a cavity, and a spring, wherein the mass body is excitable mechanically, electrically, hydraulically, magnetically or pneumatically to vibrations, which are transmittable to the control spool mechanically or hydraulically.

4. The displacement unit according to claim 1, wherein a hydraulic fluid from a pressure supply of the displacement unit serves for the creation and sustainment of the excitation forces.

5. The displacement unit according to claim 1, wherein the oscillation exciter is self-excited.

6. The displacement unit according to claim 1, wherein the valve oscillations created by the oscillation exciter act in axial direction onto the control spool.

7. A displacement unit of a hydraulic machine for the stepless adjustment of the displacement volume, having a control valve by means of which hydraulic fluid under control pressure can be guided to a hydraulic servo displacement unit, wherein, caused by an actuator or by a direct set pressure signal, a displacement of a control spool arranged slidable in the control valve sets the height of the control pressure, which can be guided to the servo displacement unit for displacing a displacement element, wherein, the displacement unit comprises an oscillation exciter which can be set into vibrations by means of excitation forces which are independent from the force of the actuator, wherein the oscillation exciter is arranged directly at the control spool or at a position feedback unit which is mechanically coupled to the control spool such that the vibrations are transmittable to the control spool; and wherein the oscillation exciter is coupled with a movable element of the position feedback unit.

8. A displacement unit of a hydraulic machine for the stepless adjustment of the displacement volume, having a control valve by means of which hydraulic fluid under control pressure can be guided to a hydraulic servo displacement unit, wherein, caused by an actuator or by a direct set pressure signal, a displacement of a control spool arranged slidable in the control valve sets the height of the control pressure, which can be guided to the servo displacement unit for displacing a displacement element, wherein, the displacement unit comprises an oscillation exciter which can be set into vibrations by means of excitation forces which are independent from the force of the actuator, wherein the oscillation exciter is arranged directly at the control spool or at a position feedback unit which is mechanically coupled to the control spool such that the vibrations are transmittable to the control spool; and wherein hydraulic fluid from the control pressure supply of the servo displacement unit under control pressure generated by the displacement unit serves for the creation and sustainment of the excitation forces.

9. A displacement unit of a hydraulic machine for the stepless adjustment of the displacement volume, having a control valve by means of which hydraulic fluid under control pressure can be guided to a hydraulic servo displacement unit, wherein, caused by an actuator or by a direct set pressure signal, a displacement of a control spool arranged slidable in the control valve sets the height of the control pressure, which can be guided to the servo displacement unit for displacing a displacement element, wherein, the displacement unit comprises an oscillation exciter which can be set into vibrations by means of excitation forces which are independent from the force of the actuator, wherein the oscillation exciter is arranged directly at the control spool or at a position feedback unit which is mechanically coupled to the control spool such that the vibrations are transmittable to the control spool; and wherein hydraulic fluid under pressure from an external hydraulic control signal generator serves for the creation and sustainment of the excitation forces.

10. A displacement unit of a hydraulic machine for the stepless adjustment of the displacement volume, having a control valve by means of which hydraulic fluid under control pressure can be guided to a hydraulic servo displacement unit, wherein, caused by an actuator or by a direct set pressure signal, a displacement of a control spool arranged slidable in the control valve sets the height of the control pressure, which can be guided to the servo displacement unit for displacing a displacement element, wherein, the displacement unit comprises an oscillation exciter which can be set into vibrations by means of excitation forces which are independent from the force of the actuator, wherein the oscillation exciter is arranged directly at the control spool or at a position feedback unit which is mechanically coupled to the control spool such that the vibrations are transmittable to the control spool;

wherein the oscillation exciter comprises a mass body movable in a cavity, and a spring, wherein the mass body is excitable mechanically, electrically, hydraulically, magnetically or pneumatically to vibrations, which are transmittable to the control spool mechanically or hydraulically; and wherein the mass body is force-locked connected via the spring to the control spool and wherein during operation the mass body opens and closes fluid channels arranged within the walls of the cavity in an oscillating manner.

11. The displacement unit according to claim 10, wherein the fluid channels are leading from a region under control pressure or servo pressure to a region of the displacement unit under a low pressure.

12. A displacement unit of a hydraulic machine for the stepless adjustment of the displacement volume, having a control valve by means of which hydraulic fluid under control pressure can be guided to a hydraulic servo displacement unit, wherein, caused by an actuator or by a direct set pressure signal, a displacement of a control spool arranged slidable in the control valve sets the height of the control pressure, which can be guided to the servo displacement unit for displacing a displacement element, wherein, the displacement unit comprises an oscillation exciter which can be set into vibrations by means of excitation forces which are independent from the force of the actuator, wherein the oscillation exciter is arranged directly at the control spool or at a position feedback unit which is mechanically coupled to the control spool such that the vibrations are transmittable to the control spool; and wherein the displacement unit is designed for the adjustment of the conveying direction of the hydraulic machine in two directions, and wherein for each conveying direction an oscillation exciter is associated, and wherein just one of the two oscillations exciters can be activated.

13. A displacement unit of a hydraulic machine for the stepless adjustment of the displacement volume, having a control valve by means of which hydraulic fluid under control pressure can be guided to a hydraulic servo displacement unit, wherein, caused by an actuator or by a direct set pressure signal, a displacement of a control spool arranged slidable in the control valve sets the height of the control pressure, which can be guided to the servo displacement unit for displacing a displacement element, wherein, the displacement unit comprises an oscillation exciter which can be set into vibrations by means of excitation forces which are independent from the force of the actuator, wherein the oscillation exciter is arranged directly at the control spool or at a position feedback unit which is mechanically coupled to the control spool such that the vibrations are transmittable to the control spool; and wherein in that the oscillation exciter comprises a plunger and a bushing arranged on the plunger, which are arranged longitudinally movable relative to each other and relative to the control spool in the longitudinal bore.

14. A control spool for a displacement unit of a hydraulic machine with an oscillation exciter which can be set into oscillations by excitation forces and which is arranged directly at the control spool such that the oscillations are transmittable to the control spool; and wherein the oscillation exciter is integrated in a cavity of the control spool.

15. The control spool according to claim 14, wherein the oscillation exciter is self-excited.

16. The control spool according to claim 15, wherein the oscillations created by the oscillation exciter act in axial direction onto the control spool.

17. A control spool for a displacement unit of a hydraulic machine with an oscillation exciter which can be set into oscillations by excitation forces and which is arranged directly at the control spool such that the oscillations are transmittable to the control spool; and wherein the oscillation exciter comprises a mass body arranged movable in a cavity of the control spool, and a spring, wherein the mass body is excitable mechanically, electrically, hydraulically, magnetically or pneumatically to oscillations, which are transmittable to the control spool mechanically or hydraulically.

18. The control spool according to claim 17, wherein the mass body is force-locked connected via the spring to the control spool, and wherein by means of the movements of the mass body fluid channels arranged in the walls of the cavity can be opened or closed periodically.

19. A control spool for a displacement unit of a hydraulic machine with an oscillation exciter which can be set into oscillations by excitation forces and which is arranged directly at the control spool such that the oscillations are transmittable to the control spool; and wherein the oscillation exciter comprises a plunger and a bushing arranged on the plunger, which are arranged in the control spool longitudinally movable relative to each other and to the control spool arranged in a longitudinal bore.

* * * * *